US011008660B2

(12) United States Patent
Rachiele et al.

(10) Patent No.: US 11,008,660 B2
(45) Date of Patent: *May 18, 2021

(54) METHOD FOR THE PRODUCTION OF A COATED METAL SHEET, COMPRISING THE APPLICATION OF AN AQUEOUS SOLUTION CONTAINING AN AMINO ACID, AND ASSOCIATED USE IN ORDER TO IMPROVE TRIBOLOGICAL PROPERTIES

(71) Applicant: ArcelorMittal, Luxembourg (LU)

(72) Inventors: Lydia Rachiele, Rombas (FR); Hervé Derule, Montoy Flanville (FR); Delphine Thaï, Bousse (FR)

(73) Assignee: ARCELORMITTAL, Luxembourg (LU)

( * ) Notice: Subject to any disclaimer, the term of this patent is extended or adjusted under 35 U.S.C. 154(b) by 180 days.

This patent is subject to a terminal disclaimer.

(21) Appl. No.: 15/546,614

(22) PCT Filed: Feb. 1, 2016

(86) PCT No.: PCT/IB2016/050504

§ 371 (c)(1),
(2) Date: Jul. 26, 2017

(87) PCT Pub. No.: WO2016/120854

PCT Pub. Date: Aug. 4, 2016

(65) Prior Publication Data

US 2018/0016681 A1 Jan. 18, 2018

(30) Foreign Application Priority Data

Jan. 30, 2015 (WO) ..... PCT/IB2015/050725

(51) Int. Cl.
*C23C 22/53* (2006.01)
*C23C 2/06* (2006.01)
(Continued)

(52) U.S. Cl.
CPC ..... *C23C 22/53* (2013.01); *C23C 2/06* (2013.01); *C23C 2/26* (2013.01); *C23C 22/68* (2013.01);
(Continued)

(58) Field of Classification Search
CPC ..... C23C 22/53
See application file for complete search history.

(56) References Cited

U.S. PATENT DOCUMENTS 3,625,744 A * 12/1971 Juna ..... B05D 1/60 427/518
3,985,695 A * 10/1976 Tobias ..... C08G 59/42 523/402
(Continued)

FOREIGN PATENT DOCUMENTS

EP 2241654 A2 10/2010
EP 2458031 A1 5/2012
(Continued)

OTHER PUBLICATIONS

International Search Report Issued in connection with International Application No. PCT/IB2015/050504, dated May 9, 2016.
(Continued)

*Primary Examiner* — James M Mellott

(57) ABSTRACT

The invention relates to a method for preparing a metal sheet (1) comprising at least the steps:

providing a steel substrate (3) having two faces (5), at least one of which is coated with a metal coating (7) comprising at least 40% by weight of zinc, applying on the outer surface (15) of the metal coating (7) an aqueous solution comprising an amino acid, and the metal sheet which may be obtained.

19 Claims, 1 Drawing Sheet

(51) Int. Cl.

| | |
|---|---|
| ***C23C 2/26*** | (2006.01) |
| ***C23F 11/14*** | (2006.01) |
| ***C25D 5/48*** | (2006.01) |
| ***C23C 22/68*** | (2006.01) |
| ***C23C 22/78*** | (2006.01) |

(52) U.S. Cl.
CPC ..... *C23F 11/144* (2013.01); *C25D 5/48* (2013.01); *C23C 22/78* (2013.01)

(56) References Cited

U.S. PATENT DOCUMENTS

| | | | | |
|---|---|---|---|---|
| 4,169,916 | A * | 10/1979 | Tsutsui | C23C 22/62 428/447 |
| 4,765,871 | A * | 8/1988 | Hsu | C25D 3/565 205/246 |
| 5,091,223 | A * | 2/1992 | Mori | C23C 22/68 427/383.7 |
| 5,209,788 | A * | 5/1993 | McMillen | C23C 22/83 148/247 |
| 6,162,508 | A | 12/2000 | Trumble et al. | |
| 6,432,220 | B1 | 8/2002 | Lindemann et al. | |
| 6,528,182 | B1 | 3/2003 | Bello et al. | |
| 7,749,368 | B2 | 7/2010 | McMurdie et al. | |
| 2002/0081452 | A1 * | 6/2002 | Nakajima | C23C 2/14 428/659 |
| 2004/0104122 | A1 * | 6/2004 | Bibber | C23C 22/53 205/196 |
| 2005/0121114 | A1 | 6/2005 | Fenandez Gonzalez et al. | |
| 2006/0193988 | A1 | 8/2006 | Walter et al. | |
| 2010/0261024 | A1 * | 10/2010 | Sakashita | C23F 11/149 428/457 |
| 2012/0145282 | A1 | 6/2012 | Kodama et al. | |
| 2014/0360630 | A1 * | 12/2014 | Arnold | C23C 22/83 148/247 |
| 2015/0352825 | A1 | 12/2015 | Richard et al. | |
| 2016/0010216 | A1 | 1/2016 | Allely et al. | |
| 2018/0057946 | A1 * | 3/2018 | Dadvand | C23C 22/53 |

FOREIGN PATENT DOCUMENTS

| | | | |
|---|---|---|---|
| JP | S49009020 | B | 3/1974 |
| JP | S50115138 | A | 9/1975 |
| JP | 2002086613 | A | 3/2002 |
| JP | 2002363799 | A | 12/2002 |
| JP | 2005529189 | A | 9/2005 |
| JP | 2005325404 | A | 11/2005 |
| JP | 2006519307 | A | 8/2006 |
| JP | 2007284710 | | 11/2007 |
| JP | 2009068085 | A | 4/2009 |
| WO | 00115878 | A1 | 3/2000 |
| WO | 2008076684 | A1 | 6/2008 |
| WO | 2008076694 | A1 | 6/2008 |
| WO | 2013160867 | A1 | 10/2013 |

OTHER PUBLICATIONS

English Abstract of JP2007284710 (Nov. 1, 2007).
Electronic translation of JP 2007284710A (Nov. 1, 2007).

* cited by examiner

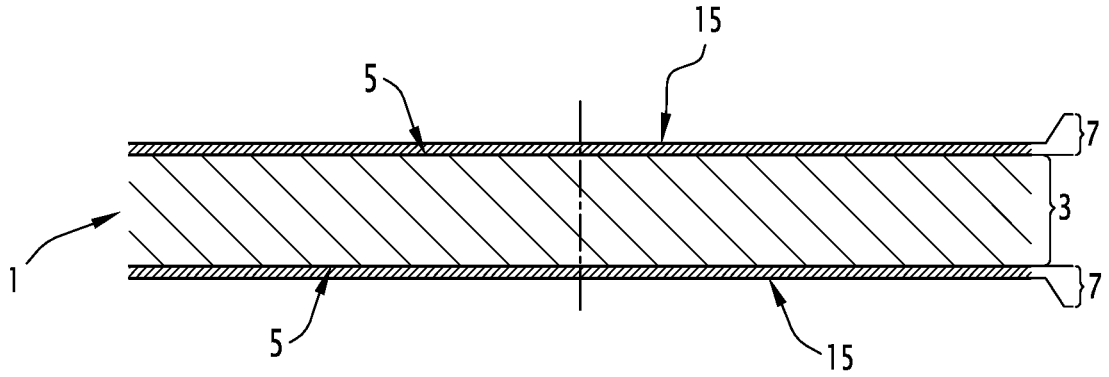
15
5
7
3
1
7
5
15

METHOD FOR THE PRODUCTION OF A COATED METAL SHEET, COMPRISING THE APPLICATION OF AN AQUEOUS SOLUTION CONTAINING AN AMINO ACID, AND ASSOCIATED USE IN ORDER TO IMPROVE TRIBOLOGICAL PROPERTIES

FIELD OF THE INVENTION

The present invention is directed to a metal sheet comprising a steel substrate having two faces, at least one of which is coated with a metal coating comprising at least 40% by weight of zinc, to its preparation method and to the use of an amino acid for improving the tribological properties of metal sheets coated with coatings based on zinc.

These coated steel sheets are for example intended for the automotive field. The metal coatings essentially comprise zinc are traditionally used for their good protection against corrosion.

Before being used, the coated steel sheets are generally subject to diverse surface treatments.

Application US 2010/0261024 describes the application of an aqueous solution of glycine or glutamic acid in a neutral or salt form on a steel sheet covered with a coating based on zinc for improving the resistance to corrosion of the metal sheet.

The application WO 2008/076684 describes the application on a steel sheet coated with zinc, on an electro-zinc-plated steel sheet or on a galvanized steel sheet with a pre-treatment composition consisting in an aqueous solution comprising a compound comprising a metal from the group IIIB (Sc, Y, La, Ac) or from the group IVB (Ti, Zr, Hf, Rf) and a compound based on copper, for example copper aspartate or glutamate, followed by the application of a composition comprising a film-forming resin and a compound based on yttrium. This treatment with a compound based on copper is described as improving resistance to corrosion of the metal sheet.

Application EP 2 458 031 describes the application on a galvanized steel sheet GI, or alloyed galvanized steel sheet GA, of a conversion treatment solution comprising a compound (A) selected from among water-soluble titanium or zirconium compounds and an organic compound (B) which may notably be glycine, alanine, asparagine, glutamic or aspartic acid in a neutral or salt form. According to this application, the compound (A) forms on the metal sheet a conversion film which improves the compatibility of the metal sheet with the applied coatings subsequently, such as cataphoretic paints, and its resistance to corrosion. The compound (B) is described as stabilizing the compound (A).

The application WO 00/15878 describes a method for preparing a metal sheet coated with a metal layer based on zinc having good tribological properties well adapted to the shaping, notably by drawing by a hydroxysulfatation treatment. The development of alternative methods giving the possibility of obtaining metal sheets having good tribological properties is sought.

BRIEF SUMMARY OF THE INVENTION

An object of the invention is therefore to provide a method for preparing a steel sheet coated with a metal coating comprising at least 40% by weight of zinc, which has good tribological properties well adapted to its subsequent shaping, notably by drawing.

It is also known that the chemical or electrochemical stripping methods, for annealing under certain atmospheric conditions, for galvanization or further electro-zinc-plating generate absorption of hydrogen by the steel. This hydrogen causes fragilization and may be suppressed by a thermal degassing treatment, which typically consists in annealing based on a temperature of the order of 200° C. Such a treatment is generally achieved at the end of the method for preparing the metal sheet, typically after the step for applying a film of grease or oil on the outer surface 15 of the metal coating 7.

The present application provides a method for preparing a steel sheet coated with a metal coating comprising at least 40% by weight of zinc which advantageously retains good tribological properties after a thermal degassing treatment.

For this purpose, the invention is directed to a method for preparing a metal sheet 1 comprising at least the steps of:

- providing a steel substrate 3, at least one face 5 of which is coated with a metal coating 7 comprising at least 40% by weight of zinc,
- applying on the outer surface 15 of the metal coating 7 an aqueous solution comprising an amino acid selected from among alanine, arginine, aspartic acid, cysteine, glutamine, lysine, methionine, proline, threonine, each amino acid being in a neutral or salt form,
- the aqueous solution being free of compound comprising a metal from the group IIIB or from the group IVB, and
- the mass percentage as dry extract of the amino acid in a neutral or salt form or of the mixture of amino acids in neutral or salt forms in the aqueous solution being greater than or equal to 50%.

The method may also comprise the following characteristics, taken individually or as a combination:

- the method comprises a preliminary step for preparing the steel substrate 3, at least one face 5 of which is coated with a metal coating 7, selected from among hot galvanization, sonic vapor jet deposition and an electro-zinc-plating of the steel substrate 3;
- the metal coating 7 is selected from a zinc coating GI, a coating GA, an alloy of zinc and aluminum, an alloy of zinc and of magnesium and an alloy of zinc, magnesium and aluminum;
- the metal coating 7 is an alloy of zinc and of magnesium comprising between 0.1 and 10% by weight of Mg and optionally between 0.1 and 20% by weight of Al, the remainder of the metal coating being Zn, the inevitable impurities and optionally one or several additional elements selected from among Si, Sb, Pb, Ti, Ca, Mn, Sn, La, Ce, Cr, Ni or Bi;
- the amino acid is selected from among alanine, arginine, aspartic acid, cysteine, lysine, methionine, proline, threonine, and a mixture thereof, each amino acid being in a neutral or salt form;
- the steel substrate 3, at least one face 5 of which is coated with a metal coating 7 has been prepared by electro-zinc-plating and the amino acid is selected from among aspartic acid, cysteine, methionine, proline and threonine, and a mixture thereof, each amino acid being in a neutral or salt form;
- the steel substrate 3, at least one face 5 of which is coated with a metal coating 7 has been prepared by hot galvanization and the amino acid is selected from among alanine, arginine, cysteine, lysine, methionine, proline, threonine, and a mixture thereof, each amino acid being in a neutral or salt form;

the amino acid is selected from among proline in a neutral or salt form, cysteine in a neutral or salt form, and a mixture thereof;

the amino acid is proline in a neutral or salt form;

the amino acid is threonine in a neutral or salt form;

the amino acid is a mixture of proline and threonine, the proline and the threonine being in a neutral or salt form;

the aqueous solution comprises from 1 to 200 g/L of amino acid in a neutral or salt form or a mixture of amino acids in neutral or salt forms;

the aqueous solution comprises from 10 to 1,750 mmol/L of amino acid in a neutral or salt form or a mixture of amino acids in neutral or salt forms;

the mass percentage as dry extract of the amino acid in a neutral or salt form or of a mixture of amino acids in neutral or salt forms in the aqueous solution is greater than or equal to 75%;

the aqueous solution has a pH comprised between a pH equal to [isoelectric point of the amino acid−3] and a pH equal to the [isoelectric point of the amino acid+1], preferably comprised between a pH equal to the [isoelectric point of the amino acid−3] and a pH equal to the [isoelectric point of the amino acid−1];

the aqueous solution is applied at a temperature comprised between 20 and 70° C.

the solution is applied for a period comprised between 0.5 s and 40 s on the outer surface 15 of the metal coating 7;

the solution is applied by roll coating;

the method comprises, after the step for applying on the outer surface 15 of the metal coating 7 an aqueous solution comprising an amino acid, a drying step.

the drying is carried out by subjecting the metal sheet 1 to a temperature comprised between 70 and 120° C. for 1 to 30 seconds;

the method comprises, after the step for applying on the outer surface 15 of the metal coating 7 an aqueous solution comprising an amino acid and the optional drying step, a step for applying a grease or oil film on the outer surface 15 of the coating 7 coated with a layer comprising an amino acid or a mixture of amino acids;

the method comprises after the step for applying on the outer surface 15 of the metal coating 7 an aqueous solution comprising an amino acid, the optional drying step and the optional step for applying a grease or oil film, a step for shaping the metal sheet 1;

the shaping of the metal sheet 1 is achieved by drawing.

The invention is also directed to a metal sheet which may be obtained by the method according to the invention, wherein at least one portion of at least one outer surface 15 of the metal coating 7 can be coated with a layer comprising from 0.1 to 200 mg/m2 of amino acid in a neutral or salt form or a mixture of amino acids in neutral or salt forms; and/or wherein at least one portion of at least one outer surface 15 of the metal coating 7 can be coated with a layer comprising from 50 to 100% by weight of an amino acid in a neutral or salt form, or of a mixture of amino acids in neutral or salt forms and the following uses:

the use of an aqueous solution comprising an amino acid selected from among alanine, arginine, aspartic acid, glutamic acid, cysteine, glutamine, glycine, lysine, methionine, proline, threonine, and a mixture thereof, each amino acid being in a neutral or salt form, the aqueous solution being free of compound comprising a metal from the group IIIB or from the group IVB, for improving the tribological properties of an outer surface 15 of a metal coating 7 coating at least one face 5 of a steel substrate 3, wherein the metal coating 7 comprises at least 40% by weight of zinc;

the use of an aqueous solution comprising an amino acid selected from among proline, threonine and a mixture thereof, the proline and the threonine being independently in a neutral or salt form, the aqueous solution being free of compound comprising a metal from the group IIIB or from the group IVB, for:

improving the compatibility, with an adhesive 13, of at least one portion of an outer surface 15 of a metal coating 7 coating at least one face 5 of a steel substrate 3, improving the resistance to corrosion of the outer surface 15 of the metal coating 7 coating at least one face 5 of the steel substrate 3, and improving the tribological properties of the outer surface 15 of the metal coating 7 coating at least one face 5 of the steel substrate 3, wherein the metal coating 7 comprises at least 40% by weight of zinc.

BRIEF DESCRIPTION OF DRAWINGS

FIG. 1 is a schematic sectional view illustrating the structure of a metal sheet 1 obtained by a method according to the invention.

DETAILED DESCRIPTION OF THE INVENTION

The invention will now be illustrated with examples given as an indication, and not as a limitation, and with reference to the appended FIG. 1.

The metal sheet 1 of the FIGURE comprises a steel substrate 3 covered on each of its two faces 5 with a metal coating 7. It will be observed that the relative thicknesses of the substrate 3 and of the coatings 7 covering it have not been observed on the FIGURE in order to facilitate the illustration.

The coatings 7 present on both faces 5 are analogue and a single one will be described in detail subsequently. Alternatively (not shown), only one of the faces 5 has a metal coating 7.

The metal coating 7 comprises more than 40% by weight of zinc, notably more than 50% by weight of zinc, preferably more than 70% by weight of zinc, more preferentially more than 90%, preferably more than 95%, preferably more than 99%. The balance may consist of the metal elements Al, Mg, Si, Fe, Sb, Pb, Ti, Ca, Sr, Mn, Sn, La, Ce, Cr, Ni or Bi, taken alone or as a combination. The measurement of the composition of a coating is generally achieved by chemical dissolution of the coating. The given result corresponds to an average content in the whole of the layer.

The metal coating 7 may comprise several successive layers of different compositions, each of these layers comprising more than 40% by weight of zinc (or more, as defined above). The metal coating 7 or one of its constitutive layers, may also have a concentration gradient in a given metal element. When the metal coating 7, or one of its constitutive layers, has a zinc concentration gradient, the average proportion of zinc in the metal coating 7, or in this constitutive layer is more than 40% by weight of zinc (or more, as defined above).

In order to manufacture this metal sheet 1, it is for example possible to proceed as follows.

The method may comprise a preliminary step for preparing the steel substrate 3 having two faces 5, at least one of which is coated with a metal coating 7 comprising at least 40% by weight of zinc. A steel substrate 3 is used, for example obtained by hot and then cold rolling. The metal coating 7 comprising more than 40% by weight of zinc may be deposited on the substrate 3 by any known deposition method, notably by electro-zinc-plating, by physical vapor deposition (PVD), by sonic jet vapor deposition (JVD) or hot dip galvanization.

According to a first alternative, the steel substrate 3 having two faces 5, at least one of which is coated with a metal coating 7 comprising at least 40% by weight of zinc is obtained by electro-zinc-plating of the steel substrate 3. The application of the coating may take place on one face (the metal sheet 1 then only comprising a metal coating 7), or on both faces (the metal sheet 1 then comprises two metal layers 7).

According to a second alternative, the steel substrate 3 having two faces 5, at least one of which is coated with a metal coating 7 comprising at least 40% by weight of zinc is obtained by hot galvanization of the steel substrate 3.

Generally, the substrate 3 is then in the form of a strip which is run in a bath for depositing the metal coating 7 by hot quenching. The composition of the bath varies according to whether the desired metal sheet 1 is a galvanized steel sheet GI, GA steel sheet (alloyed galvanized sheet or "galvannealed steel sheet") or a metal sheet coated with an alloy of zinc and magnesium, an alloy of zinc and aluminum or an alloy of zinc, magnesium and aluminum. The bath may also contain up to 0.3% by weight of additional optional elements such as Si, Sb, Pb, Ti, Ca, Mn, Sn, La, Ce, Cr, Ni or Bi. These different additional elements may notably give the possibility of improving the ductility or the adhesion of the metal coating 7 on the substrate 3. One skilled in the art, which is aware of their effects on the characteristics of the metal coating 7, will know how to use them depending on the sought complementary purpose. The bath may finally contain residual elements stemming from supply ingots, or resulting from the passage of the substrate 3 in the bath, a source of inevitable impurities in the metal coating 7.

In an embodiment, the steel substrate 3 having two faces 5, at least one of which is coated with a metal coating 7 comprising at least 40% by weight of zinc, is a galvanized steel sheet GI. The metal coating 7 is then a zinc coating GI. Such a coating comprises more than 99% by weight of zinc.

In another embodiment, the steel substrate 3 having two faces 5, at least one of which is coated with a metal coating 7 comprising at least 40% by weight of zinc is a galvanized steel sheet GA. The metal coating 7 is then a zinc coating GA. A galvanized steel sheet GA is obtained by annealing of a galvanized steel sheet GI. In this case, the method therefore comprises a hot galvanization step of the steel substrate 3, and then an annealing step. The annealing causes diffusion of the iron of the steel substrate 3 into the metal coating 7. The metal coating 7 of a GA metal sheet typically comprises from 10% to 15% by weight of iron.

According to another embodiment, the metal coating 7 is an alloy of zinc and of aluminum. The metal coating 7 may for example comprise 55% by weight of aluminum, 43.5% by weight of zinc and 1.5% by weight of silicone, like Aluzinc® marketed by ArcelorMittal.

In another embodiment, the metal coating 7 is an alloy of zinc and of magnesium, preferably comprising more than 70% by weight of zinc. The metal coatings comprising zinc and magnesium will globally be referred to here under the term of zinc-magnesium or ZnMg coatings. The addition of magnesium to the metal coating 7 clearly increases the resistance to corrosion of these coatings, which may give the possibility of reducing their thickness or increasing the guarantee of protection against corrosion over time.

The metal coating 7 may notably be a zinc, magnesium and aluminum alloy, preferably comprising more than 70% by weight of zinc. The metal coatings comprising zinc, magnesium and aluminum will globally be designated here under the term of zinc-aluminum-magnesium or ZnAlMg coatings. The addition of aluminum (typically of the order of 0.1% by weight) to a coating based on zinc and magnesium also gives the possibility of improving the resistance to corrosion, and makes the coated metal sheet easier to shape. Thus, the metal coatings essentially comprising zinc are now in competition with coatings comprising zinc, magnesium and optionally aluminum.

Typically, the metal coating 7 of the ZnMg or ZnAlMg type comprises between 0.1 and 10% by weight, typically between 0.3 and 10% by weight, notably between 0.3 and 4% by weight of magnesium. Below 0.1% by weight of Mg, the coated metal sheet resists not very well to corrosion and beyond 10% by weight of Mg, the ZnMg or ZnAlMg coating oxidizes too much and cannot be used.

In the sense of the present application, when a range of FIGURES is described as being between a low limit and an upper limit, it is understood that these limits are included. For example, a coating comprising 0.1% or 10% by weight of magnesium is included when the expression "The metal coating 7 comprises between 0.1 and 10% by weight of magnesium" is used.

The metal coating 7 of the ZnAlMg type comprises aluminum, typically between 0.5 and 11% by weight, notably between 0.7 and 6% by weight, preferably between 1 and 6% by weight of aluminum. Typically, the mass ratio between the magnesium and the aluminum in the metal coating 7 of the ZnAlMg type is strictly less than or equal to 1, preferably strictly less than 1, and still preferably strictly less than 0.9.

The most common inevitable impurity present in the metal coating 7 and resulting from the passage of the substrate in the bath is iron which may be present at a content ranging up to 3% by weight, generally less than or equal to 0.4% by weight, typically comprised between 0.1 and 0.4% by weight based on the metal coating 7.

The inevitable impurities from supply ingots, for the ZnAlMg baths are generally lead (Pb), present at a content of less than 0.01% by weight based on the metal coating 7, cadmium (Cd) present at a content of less than 0.005% by weight based on the metal coating 7 and tin (Sn) present at a content of less than 0.001% by weight based on the metal coating 7.

Additional elements selected from among Si, Sb, Pb, Ti, Ca, Mn, Sn, La, Ce, Cr, Ni or Bi may be present in the metal coating 7. The weight content of each additional element is generally less than 0.3%.

The metal coating 7 generally has a thickness of less than or equal to 25 μm and conventionally aims at protecting the steel substrate 3 against corrosion.

After deposition of the metal coating 7, the substrate 3 is for example wrung by means of nozzles projecting a gas on either side of the substrate 3.

The metal coating 7 is then left to cool in a controlled way so that it solidifies. The controlled cooling of the metal coating 7 is ensured at a rate preferably greater than or equal to 15° C./s or further greater than 20° C./s between the beginning of the solidification (i.e. when the metal coating 7 falls just below the temperature of the liquidus) and the end of solidification (i.e. when the metal coating 7 attains the temperature of the solidus).

Alternatively, the wringing operation may be adapted for removing the metal coating 7 deposited on one face 5 so that only one of the faces 5 of the metal sheet 1 is definitively coated by a metal coating 7.

The thereby treated strip may then be subject to a so called skin-pass step which allows it to be work hardened and gives it roughness facilitating its subsequent shaping.

The outer surface 15 of the metal coating 7 is subject to a surface treatment step which consists of applying to them an aqueous solution comprising an amino acid selected from among alanine, arginine, aspartic acid, glutamic acid, cysteine, glutamine, glycine, lysine, methionine, proline, threonine and a mixture thereof. Each amino acid may be in a neutral or salt form. In the sense of the application, an amino acid is one of the 22 protein-generating amino acids (isomer L) or one of their isomers, notably their isomers D. The amino acid is preferably an amino acid L for reasons of cost.

The invention is based on the unexpected discovery that the application on the outer surface 15 of the metal coating 7 of an aqueous solution comprising an amino acid from the list defined above gives the possibility of improving the tribological properties of the obtained metal sheet, which facilitates its subsequent shaping, notably by drawing. This improvement is not observed regardless of the amino acid used. For example, the tribological properties were not improved by applying valine or serine on a metal sheet coated with a metal coating 7 comprising at least 40% by weight of zinc. No theory for the moment has been put forward for explaining why certain amino acids give the possibility of improving the tribological properties and not other ones.

The aqueous solution applied may comprise an amino acid selected from among alanine, aspartic acid, glutamic acid, cysteine, glutamine, glycine, methionine, proline, threonine and a mixture thereof, each amino acid being in a neutral or salt form.

The applied aqueous solution may comprise an amino acid selected from among alanine, aspartic acid, glutamic acid, glutamine, glycine, methionine, proline, threonine, and a mixture thereof, each amino acid being in a neutral or salt form.

The applied aqueous solution may notably comprise an amino acid selected from among alanine, arginine, aspartic acid, glutamic acid, cysteine, glycine, lysine, methionine, proline, threonine and a mixture thereof, each amino acid being in a neutral or salt form.

The applied aqueous solution may comprise an amino acid selected from among alanine, arginine, aspartic acid, glutamic acid, glycine, lysine, methionine, proline, threonine and a mixture thereof, each amino acid being in a neutral or salt form.

The applied aqueous solution may typically comprise an amino acid selected from among alanine, aspartic acid, glutamic acid, cysteine, glycine, methionine, proline, threonine and a mixture thereof, each amino acid being in a neutral or salt form.

The applied aqueous solution may typically comprise an amino acid selected from among alanine, aspartic acid, glutamic acid, glycine, methionine, proline, threonine and a mixture thereof, each amino acid being in a neutral or salt form.

Preferably, in the first alternative wherein the metal sheet 1 is a electro-zinc-plated steel sheet, the amino acid of the applied aqueous solution is selected from among aspartic acid, cysteine, methionine, proline and threonine, and a mixture thereof, each amino acid being in a neutral or salt form, in particular from among cysteine, methionine, proline and threonine, and a mixture thereof, each amino acid being in a neutral or salt form, for example from among methionine, proline and threonine, and a mixture thereof, each amino acid being in a neutral or salt form.

Preferably, in the second alternative in which the metal sheet 1 is a metal sheet obtained by hot galvanization of the steel substrate 3, the amino acid of the applied aqueous solution is selected from among alanine, arginine, glutamic acid, cysteine, glycine, lysine, methionine, proline, threonine, and a mixture thereof, each amino acid being in a neutral or salt form. Typically, the amino acid of the applied aqueous solution is selected from among alanine, glutamic acid, cysteine, glycine, methionine, proline, threonine, and a mixture thereof, each amino acid being in a neutral or salt form, for example from among alanine, glutamic acid, glycine, methionine, proline, threonine, and a mixture thereof, each amino acid being in a neutral or salt form.

Preferably, in the third alternative in which the metal sheet 1 is equally an electro-zinc-plated steel sheet or a metal sheet obtained by hot galvanization of the steel substrate 3, the amino acid of the applied aqueous solution is selected from among cysteine, methionine, proline and threonine and a mixture thereof, each amino acid being in a neutral or salt form, for example from among methionine, proline and threonine and a mixture thereof, each amino acid being in a neutral or salt form.

The amino acid is notably selected from among proline in a neutral or salt form, cysteine in a neutral or salt form, and from a mixture thereof. The proline is particularly efficient for improving the tribological properties of the metal sheet 1. Cysteine advantageously gives the possibility of dosing the amount of amino acid deposited at the surface by means of its thiol function, for example by X fluorescence spectrometry (XFS).

Preferably, the amino acid is selected from among proline in a neutral or salt form, threonine in a neutral or salt form, and a mixture thereof. The proline and the threonine actually give the possibility not only of improving the tribological properties of the surface of the metal sheet, but also of improving the compatibility of the surface with an adhesive and improving the resistance to corrosion of the metal sheet.

The improvement in the resistance to corrosion may for example be shown by conducting tests according to the ISO 6270-2 2005 standards and/or VDA 230-213 2008 standards, and the improvement in the compatibility of the surface of the metal sheet with an adhesive may for example be shown by conducting tensile tests on samples of metal sheet assembled via an adhesive and optionally aged until breakage of the assembly and by measuring the maximum tensile stress and the nature of the fracture.

It is particularly surprising that threonine and/or proline give the possibility of improving these three properties at a time. Under the tested conditions, the other amino acids did not allow an improvement in the three properties on any type of metal coating comprising at least 40% by weight of zinc (at best, the other amino acids gave the possibility of observing an improvement in two of these properties, but not of the three).

The applied aqueous solution generally comprises from 1 to 200 g/L, notably from 5 g/L to 150 g/L, typically from 5 g/L to 100 g/L, for example from 10 to 50 g/L of amino acid in a neutral or salt form and of a mixture of amino acids in neutral or salt forms. The most significant improvement in the tribological properties of the metal coating 7 of the metal sheet 1 was observed by using an aqueous solution comprising from 5 g/L to 100 g/L, in particular from 10 to 50 g/L of amino acid or of a mixture of amino acids. When the amino acid is threonine, the most significant improvement in the tribological properties of the metal sheet 1 was observed by using an aqueous solution comprising from 5 g/L to 50 g/L, in particular from 10 to 50 g/L of threonine. When the amino acid is proline and the metal coating (7) was obtained by hot galvanization of the steel substrate 3, the most significant improvement in the tribological properties of the metal sheet 1 was observed by using an aqueous solution comprising from 5 g/L to 100 g/L, in particular from 10 to 50 g/L of proline.

The applied aqueous solution generally comprises from 10 to 1,750 mmol/L, notably from 40 mmol/L to 1,300 mmol/L, typically from 40 mmol/L to 870 mmol/L, for example from 90 to 430 mmol/L of amino acid in neutral or salt form or of a mixture of amino acids in neutral or salt forms. The most significant improvement in the tribological properties of the metal coating 7 of the metal sheet 1 was observed by using an aqueous solution comprising from 40 mmol/L to 870 mmol/L, in particular from 90 to 430 mmol/L of amino acid or of a mixture of amino acids. When the amino acid is threonine or one of its salts, the most significant improvement in the tribological properties of the metal sheet 1 was observed by using an aqueous solution comprising from 40 mmol/L to 430 mmol/L, in particular from 90 mmol/L to 430 mmol/L of threonine or of one of its salts. When the amino acid is proline or one of its salts and the metal coating (7) was obtained by hot galvanization of the steel substrate 3, the most significant improvement in the tribological properties of the metal sheet 1 was observed by using an aqueous solution comprising from 40 mmol/L to 870 mmol/L, in particular from 90 mmol/L to 430 mmol/L of proline or of one of its salts.

Of course, the mass and molar proportions of the amino acid (or of each of the amino acids when a mixture of amino acids is used) in the aqueous solution cannot be greater than the proportions corresponding to the solubility limit of the amino acid at the temperature at which the aqueous solution is applied.

Generally, the mass percentage as dry extract of the amino acid in a neutral or salt form or of the mixture of amino acids in neutral or salt forms in the aqueous solution is greater than or equal to 50%, notably greater than or equal to 65%, typically greater than or equal to 75%, notably greater than or equal to 90%, preferably greater than or equal to 95%. Also, generally, the molar percentage as dry extract of the amino acid in a neutral or salt form in the aqueous solution is greater than or equal to 50%, typically greater than or equal to 75%, notably greater than or equal to 90%, preferably greater than or equal to 95%.

The aqueous solution may comprise zinc sulfate and/or iron sulfate. The zinc sulfate proportion in the aqueous solution is generally less than 80 g/L, preferably less than 40 g/L. Preferably, the aqueous solution is free of zinc sulfate and any iron sulfate.

Generally, the aqueous solution comprising an amino acid comprises less than 10 g/L, typically less than 1 g/L, generally less than 0.1 g/L, notably less than 0.05 g/L, for example less than 0.01 g/L of zinc ions. Preferably, the aqueous solution is free of zinc ion (in addition to inevitable trace amounts, which may for example come from pollution, by the substrate, of the bath of the aqueous solution).

The aqueous solution comprising an amino acid generally comprises less than 0.005 g/L of iron ions. The aqueous solution comprising an amino acid generally comprises not very many metal ions other than potassium, sodium, calcium and zinc ions, typically less than 0.1 g/L, notably less than 0.05 g/L, for example less than 0.01 g/L, preferably less than 0.005 g/L of metal ions other than potassium, sodium, calcium and zinc ions. Typically, the aqueous solution is free of metal ions other than zinc, sodium, calcium and potassium. The aqueous solution comprising an amino acid generally comprises not very many metal ions other than zinc, typically less than 0.1 g/L, notably less than 0.05 g/L, for example less than 0.01 g/L, preferably less than 0.005 g/L of metal ions other than zinc. Typically, the aqueous solution is free of metal ions other than zinc. In particular, the aqueous solution comprising an amino acid generally comprises not very many cobalt and/or nickel ions, typically less than 0.1 g/L, notably less than 0.05 g/L, for example less than 0.01 g/L of cobalt and/or nickel ions. Preferably, the aqueous solution is free of cobalt ions and/or free of nickel ions and/or free of copper ions and/or free of nickel ions and/or free of copper ions and/or free of chromium ions. The aqueous solution is free of compound comprising a metal from the group IIIB (Sc, Y, La, Ac) or from the group IVB (Ti, Zr, Hf, Rf). Preferably, it is free of metal ions (in addition to the inevitable metal impurities which may for example stem from pollution, by the substrate of the bath of the aqueous solution).

Generally, the absence of metal ions in the aqueous solution gives the possibility of avoiding perturbation of the action of the active ingredient which is the amino acid or the mixture of amino acids.

Further, the aqueous solution comprising an amino acid generally comprises less than 0.1 g/L, notably less than 0.05 g/L, for example less than 0.01 g/L of compounds comprising chromium VI, or more generally chromium. Generally, it is free of compounds comprising chromium VI, or more generally chromium.

Moreover, the aqueous solution is generally free of oxidizing agent.

Moreover, the aqueous solution is generally free of resin, in particular any organic resin. A resin refers to a polymeric material (natural, artificial or synthetic) which is a raw material for manufacturing for example plastic materials, textiles, paints (liquids or powdery), adhesives, varnishes, polymeric foams. It may be thermoplastic or thermosetting. More generally, the aqueous solution is generally free of polymer.

The absence of resin gives the possibility of obtaining a treatment layer with a small thickness and of thereby facilitating its removal during the degreasing preceding phosphating and painting. A resin has, under these conditions, a tendency of leaving residues which will perturb the phosphating.

The pH of the applied aqueous solution is generally comprised from a pH equal to the [isoelectric point of the amino acid−3] at a pH equal to the [isoelectric point of the amino acid+3], notably with a pH equal to the [isoelectric point of the amino acid−2] to a pH equal to the [isoelectric point of the amino acid+2], preferably with a pH equal to the [isoelectric point of the amino acid−1] to a pH equal to [isoelectric point of the amino acid+1]. For example, when the amino acid is proline, the isoelectric point of which is 6.3, the pH of the aqueous solution is generally from 3.3 to 9.3, notably from 4.3 to 8.3, preferably from 5.3 to 7.3.

The pH of the applied aqueous solution is generally comprised from a pH equal to the [isoelectric point of the amino acid−3] to a pH equal to the [isoelectric point of the amino acid+1], preferably with a pH equal to the [isoelectric point of the amino acid−3] to a pH equal to the [isoelectric point of the amino acid−1], notably from a pH equal to the [isoelectric point of the amino acid−2.5] to a pH equal to the [isoelectric point of the amino acid−1.5], typically a pH equal to the [isoelectric point of the amino acid−2]. For example, when the amino acid is proline, the isoelectric point of which is 6.3, the pH of the aqueous solution is preferably from 3.3 to 5.3, notably from 3.8 to 4.8, typically of the order of 4.0, like 4.3. Such a pH actually gives the possibility of promoting the binding between the amino acid and the metal coating 7. In particular, a method applied with a solution having such a pH gives the possibility of obtaining a metal sheet which retains its improved tribological properties, even when it has undergone a washing/re-oiling treatment. Generally once the metal sheet according to the invention has been prepared, it may be cut out into blanks before its shaping, typically by drawing. In order to remove the impurities deposited on the metal sheet from this cutting out, a washing/re-oiling treatment may be applied. The latter consists of applying on the surfaces of the metal sheet an oil with a low viscosity, and then of brushing, and then applying an oil with a greater viscosity. Without intending to be bound by a particular theory, it is assumed that a solution having such a pH gives the possibility of obtaining the amino acid in a protonated form ($NH_3^+$), which would promote the binding between the amino acid and the metal coating 7 and therefore the maintaining of the amino acid at the surface in spite of the washing/re-oiling treatment. At different pH's and notably greater than the [isoelectric point of the amino acid−1], the amine of the amino acid is little or not at all protonated: the bonds between the amino acid and the metal coating 7 will be less strong and the amino acid will have more tendency to dissolve in the oil used during the washing/re-oiling treatment, leading to its at least partial removal, and therefore to not as good tribological properties of the surface of the metal sheet having undergone such a treatment.

One skilled in the art knows how to adapt the pH of the aqueous solution, by adding a base if the intention is to increase the pH, or an acid, such as phosphoric acid, if the intention is to decrease it.

In the sense of the application, a base or an acid is equally in a neutral and/or salt form. Generally, the acid proportion is less than 10 g/L, notably 1 g/L in the solution. Preferably, the phosphoric acid is added together in a neutral form and in a salt form (for example of sodium, of calcium or further of potassium) for example in a $H_3PO_4/NaH_2PO_4$ mixture. The phosphoric acid may advantageously dose the amount of aqueous solution (and therefore of amino acid) deposited at the surface by means of phosphorus and/or sodium, for example by X fluorescence spectrometry (XFS).

In an embodiment, the aqueous solution consists in a mixture of water, of amino acid in a neutral or salt form or of a mixture of amino acids independently in neutral or salt forms and optionally a base or a mixture of bases, or an acid or a mixture of acids. The base or the acid is used for adapting the pH of the aqueous solution. The amino acid gives the improved tribological properties. The base or the acid gives the possibility of reinforcing this effect. The addition of other compounds is not necessary.

In the method according to the invention, the aqueous solution comprising an amino acid may be applied at a temperature comprised between 20 and 70° C. The period of application of the aqueous solution may be between 0.5 s and 40 s, preferably between 2 s and 20 s.

The aqueous solution comprising an amino acid may be applied by immersion, spraying or any other system.

The application of the aqueous solution on the outer surface 15 of the metal coating 7 may be carried out by any means, for example by immersion, by spraying or by roll coating. This last technique is preferred since it gives the possibility of more easily controlling the amount of applied aqueous solution while ensuring a homogeneous distribution of the aqueous solution on the surface. Generally, the humid film thickness consisting of the applied aqueous solution on the outer surface 15 of the metal coating 7 is from 0.2 to 5 μm, typically between 1 and 3 μm.

By "application on the outer surface 15 of the metal coating 7 of an aqueous solution comprising an amino acid", is meant that the aqueous solution comprising an amino acid is put into contact with the outer surface 15 of the metal coating 7. It is therefore understood that the outer surface 15 of the metal coating 7 is not covered with an intermediate layer (a film, a coating or a solution) which would prevent the contacting of the aqueous solution comprising an amino acid with the outer surface 15 of the metal coating 7.

Typically, the method comprises, after the surface for application on the outer surface 15 of the metal coating 7 of an aqueous solution comprising an amino acid, a drying step, which gives the possibility of obtaining on the outer surface 15 of the metal coating 7 a layer comprising (or consisting of) an amino acid (in neutral or salt form) or a mixture of amino acids (independently of neutral or salt forms). The latter may be carried out by subjecting the metal sheet 1 to a temperature comprised between 70 and 120° C., for example between 80 and 100° C., generally for 1 to 30 seconds, notably 1 to 10 seconds, for example 2 s. In particular, a method applied with such a pH step gives the possibility of obtaining a metal sheet which retains its improved tribological properties, even when it has been subjected to a washing/re-oiling treatment.

The metal coating 7 of the metal sheet 1 obtained is then typically coated with a layer comprising from 0.1 to 200 $mg/m^2$, notably from 25 to 150 $mg/m^2$, in particular from 50 to 100 $mg/m^2$, for example from 60 to 70 $mg/m^2$ of amino acid (in the neutral or salt form) or of a mixture of amino acids (independently in neutral or salt forms). The amount of amino acid deposited on the outer surface 15 of the metal coating 7 may be determined by dosing the amount of amino acid deposited (for example by infrared), or else by dosing the amount of remaining amino acid in the aqueous solution (for example by acid-base dosage and/or with conductimetry), it being given that the initial concentration of amino acid of the aqueous solution is known. Further, when the amino acid or one of the amino acids is cysteine, the amount of cysteine deposited at the surface may be determined by X fluorescence spectrometry (XFS).

Generally, the layer comprising an amino acid (in a neutral or salt form) or a mixture of amino acids (independently in neutral or salt forms) which coats the metal coating 7 of the metal sheet 1 obtained comprises from 50 to 100% by weight, notably from 75 to 100% by weight, typically from 90 to 100% by weight of amino acid (in neutral or salt form) or a mixture of amino acids (independently in neutral or salt forms).

The method may comprise or be free of surface treatment step(s) other than the one consisting of applying an aqueous solution comprising an amino acid (for example a surface treatment by alkaline oxidation and/or a chemical conversion treatment). When this(these) surface treatment step(s) lead to the formation of a layer on the metal coating 7, this(these) other surface treatment step(s) is(are) carried out simultaneously or after the step for application of an aqueous solution comprising an amino acid on the outer surface 15 of the metal coating 7, so that there is no intermediate layer between the outer surface 15 of the metal coating 7 and the aqueous solution comprising an amino acid. These optional aforementioned surface treatment steps may comprise other rinsing, drying sub-steps.

After having applied the aqueous solution comprising an amino acid, a film of grease or oil is generally applied on the outer surface 15 of the metal coating 7 coated with a layer comprising an amino acid or a mixture of amino acids in order to protect it against corrosion.

The strip may optionally be wound before being stored. Typically, before shaping the part, the strip is cut out. A grease or oil film may then again be applied on the outer surface 15 of the metal coating 7 coated with a layer comprising an amino acid or a mixture of amino acids before shaping.

Preferably, the method is free of degreasing step (typically achieved by applying an aqueous solution with a basic pH generally greater than 9 on the outer surface 15 of the metal coating 7) before shaping. Indeed, the treatment with a basic aqueous solution on the outer surface 15 of the metal coating 7, coated with a layer comprising an amino acid or a mixture of amino acids may lead to partial or total removal of the amino acid(s) which were been deposited on the outer surface 15 of the metal coating 7, which one tries to avoid.

The metal sheet may then be shaped by any method adapted to the structure and to the shape of the parts to be manufactured, preferably by drawing, such as for example cold drawing. The shaped metal sheet 1 then corresponds to a part, for example an automobile part.

Once the metal sheet 1 has been shaped, the method may then comprise (or be free of):

- a degreasing step, typically achieved by applying a basic aqueous solution on the outer surface 15 of the metal coating 7, and/or
- other surface treatment steps, for example a phosphating step, and/or
- a cataphoresis step.

The invention also relates to the metal sheet 1 which may be obtained with the method. Such a metal sheet comprises at least one portion of at least one outer surface 15 of the metal coating 7 coated with a layer comprising from 0.1 to 200 mg/m$^2$, notably from 25 to 150 mg/m$^2$, in particular from 50 to 100 mg/m$^2$, for example from 60 to 70 mg/m$^2$ of an amino acid in a neutral or salt form.

The invention also relates to the use of an aqueous solution comprising an amino acid selected from among alanine, arginine, aspartic acid, glutamic acid, cysteine, glutamine, glycine, lysine, methionine, proline, threonine, and a mixture thereof, each amino acid being in a neutral or salt form, the aqueous solution being free of compound comprising a metal from the group IIIB or from the group IVB, for improving the tribological properties of an outer surface 15 of a metal coating 7 coating at least one face 5 of a steel substrate 3, wherein the metal coating 7 comprises at least 40% by weight of zinc. The improvement in the tribological properties may notably be shown by the reduction, or even suppression of the ("stick slip"), and/or by the reduction of the friction coefficient (μ) when the amino acid as defined above is applied.

The preferential embodiments described above for the aqueous solution, the conditions for applying the aqueous solution and the metal coating 7 are of course applicable.

The invention also relates to a method for improving the tribological properties of an outer surface 15 of a metal coating 7 coating at least one face 5 of a steel substrate 3, comprising at least the steps of:

- providing a steel substrate 3 having two faces 5, at least one of which is coated with a metal coating 7 comprising at least 40% by weight of zinc,
- applying on the outer surface 15 of the metal coating 7 an aqueous solution comprising an amino acid selected from among alanine, arginine, aspartic acid, glutamic acid, cysteine, glutamine, glycine, lysine, methionine, proline, threonine, and a mixture thereof, each amino acid being in neutral or salt form, the aqueous solution being free of compound comprising a metal from the group IIIB or from the group IVB.

The preferential embodiments described above for the aqueous solution, the conditions for applying the aqueous solution, the metal coating 7 and the optional additional steps in the method are of course applicable.

The invention also relates to the use of an aqueous solution comprising an amino acid selected from among proline, threonine and a mixture thereof, the proline and the threonine being independently in a neutral or salt form, the aqueous solution being free of compound comprising a metal from the group IIIB or from the group IVB, for:

- improving the compatibility with an adhesive 13, of at least one portion of an outer surface 15 of a metal coating 7 coating at least one face 5 of a steel substrate 3,
- improving resistance to corrosion of the outer surface 15 of the metal coating 7 coating at least one face 5 of the steel substrate 3, and
- improving the tribological properties of the outer surface 15 of the metal coating 7 coating at least one face 5 of the steel substrate 3, wherein the metal coating 7 comprises at least 40% by weight of zinc.

The preferential embodiments described above for the aqueous solution, the conditions for applying the aqueous solution and the metal coating 7 are of course applicable.

The invention also relates to a method for:

- improving the compatibility with an adhesive 13, of at least one portion of an outer surface 15 of a metal coating 7 coating at least one face 5 of a steel substrate 3,
- improving the resistance to corrosion of the outer surface 15 of the metal coating 7 coating at least one face 5 of the steel substrate 3, and
- improving the tribological properties of the outer surface 15 of the metal coating 7 coating at least one face 5 of the steel substrate 3, said method comprising at least the steps for:

- providing a steel substrate 3 having two faces 5, at least one of which is coated with a metal coating 7 comprising at least 40% by weight of zinc,
- applying on the outer surface 15 of the metal coating 7 an aqueous solution comprising an amino acid selected from among proline, threonine and a mixture thereof, the proline and the threonine being independently in a neutral or salt form, the aqueous solution being free of compound comprising a metal from the group IIIB or from the group IVB.

The preferential embodiments described above for the aqueous solution, the conditions for applying the aqueous solution, the metal coating 7 and the optional additional steps in the method are of course applicable.

Example 1: Tests of Measurement of the Friction Coefficient (μ) According to the Contact Pressure (MPa)

In order to illustrate the invention, measurement tests of the friction coefficient (μ) according to the contact pressure (MPa) were conducted and are described as non-limiting examples.

Samples of steel metal sheets 1 covered with a metal coating 7 comprising about 99% of zinc (steel sheet GI of grade DX56D, thickness 0.7 mm), samples of electro-zinc-plated steel sheets 1 the coating of which comprise 100% of zinc (EG steel sheet of grade DC06, thickness 0.8 mm), samples of steel sheets 1 Fortiform® electro-zinc-plated, the coating of which comprise 100% of zinc (7.5 μm on both faces) or else samples of steel sheets 1 coated by deposition with a sonic vapor jet (Zn JVD) the coating of which comprise 100% of zinc (7.5 μm on both faces) were used.

Samples having dimensions of 450 mm×35 mm×thickness (0.7 mm for GI and 0.8 mm for EG) were cut out in the steel sheets. The samples are immersed for an immersion period of 20 s at a temperature of 50° C. in an aqueous solution of amino acid, the pH of which was optionally adjusted by adding $H_3PO_4$. Fuchs® 3802-39S oil (in an amount of 3 g/m$^2$), Fuchs® 4107S (to the brink) or QUAKER 6130 (to the brink) was applied on one face of the samples.

The friction coefficient was then measured (μ) according to the contact pressure (MPa) by varying the contact pressure from 0 to 80 MPa:

on the sample of the metal sheet according to the invention thereby prepared, and on a sample of metal sheet coated but not treated with an amino acid (control).

Several test phases were then carried out (phases A, B, and C in table 1 below).

As illustrated by the table 1 below, it was observed that the application of a solution comprising an amino acid as defined above gives the possibility:

of reducing the friction coefficient relatively to a coated metal sheet not treated with such a solution (control), and/or of avoiding friction by jerks or («stick slip»), while at certain pressures, «stick slip» is observed for a coated metal sheet not treated with such a solution (control), of retaining the tribological properties of the outer surface, even after degassing heat treatment.

These advantageous effects were not observed for a metal sheet sample coated, treated with valine for which friction with jerks was observed at 42 MPa.

The other properties of the metal sheets 1 obtained by the method according to the invention (mechanical properties, compatibility with one of the subsequent steps for cataphoresis and/or phosphating and/or painting) were not degraded.

TABLE 1

Tribological properties (Observation of stick slip and friction coefficient (μ) according to the exerted pressure) for the tested metal sheet samples.

| | | | Applied aqueous solution | | | Pressure (MPa) at | | | |
|---|---|---|---|---|---|---|---|---|---|
| | | | | Concentration | pH of the | which stick | Friction coefficient (μ) | | |
| Metal sheet | Oil | | Amino acid (natural) | of amino acid (g/L) | aqueous solution | slip is observed | at 40 MPa | at 60 MPa | at 80 MPa |
| GI | Fuchs 3802-39S | A | None(control) | NA | NA | 21 | 0.180 | 0.190 | 0.200 |
| | | | Alanine | 20 | 6.0 | NA | 0.125 | 0.155 | 0.140 |
| | | | | 50 | 6.0 | NA | 0.105 | 0.095 | 0.090 |
| | | | | 100 | 6.0 | NA | 0.100 | 0.095 | 0.090 |
| | | | | 150 | 6.0 | NA | 0.100 | 0.095 | 0.085 |
| | | | Proline | 50 | 6.3 | NA | 0.145 | 0.160 | 0.150 |
| | | | | 100 | 6.3 | NA | 0.120 | 0.120 | 0.105 |
| | | | | 150 | 6.3 | NA | 0.110 | 0.105 | 0.105 |
| | | | Threonine | 20 | 5.6 | NA | 0.130 | 0.155 | 0.140 |
| | | | | 50 | 5.6 | NA | 0.110 | 0.110 | 0.100 |
| | | | | 80 | 5.6 | NA | 0.110 | 0.100 | 0.090 |
| | | | | 100 | 5.6 | NA | 0.115 | 0.110 | 0.100 |
| GI | | B | None(control) | NA | NA | 46 | 0.145 | 0.130 | 0.140 |
| | | | Cysteine | 20 | 4.0 | NA | 0.120 | 0.115 | 0.110 |
| | | | | 100 | 4.0 | NA | 0.100 | 0.100 | 0.100 |
| | | | | 150 | 4.0 | NA | 0.100 | 0.100 | 0.100 |
| | | | Glycine | 10 | 4.0 | NA | 0.120 | 0.125 | 0.115 |
| | | | | 20 | 4.0 | NA | 0.110 | 0.110 | 0.115 |
| | | | | 100 | 4.0 | NA | 0.100 | 0.095 | 0.090 |
| | | | | 200 | 4.0 | NA | 0.100 | 0.090 | 0.090 |
| | | | Glutamic acid | 10 | 4.0 | NA | 0.130 | 0.130 | 0.130 |
| | | | Arginine | 10 | 4.0 | NA | 0.120 | 0.140 | 0.135 |
| | | | | 20 | 4.0 | NA | 0.120 | 0.125 | 0.120 |
| | | | | 100 | 4.0 | NA | 0.100 | 0.100 | 0.105 |
| | | | | 150 | 4.0 | NA | 0.105 | 0.105 | 0.105 |
| GI | | C | None(control) | NA | NA | 18 | 0.18 | 0.19 | 0.17 |
| | | | Proline | 80 | 4.0* | NA | 0.13 | 0.13 | 0.12 |
| | | | Proline** | 80 | 4.0* | NA | 0.14 | 0.14 | 0.13 |
| EG | | | None(control) | NA | NA | 43 | 0.170 | 0.200 | 0.190 |
| DC06 | | | Aspartic acid | 5 | natural | 40 | 0.145 | 0.130 | 0.120 |
| | | | Cysteine | 30 | natural | NA | 0.140 | 0.130 | 0.120 |
| | | | Methionine | 50 | natural | NA | 0.120 | 0.130 | 0.150 |
| | | | Proline | 50 | Natural | NA | 0.120 | 0.120 | 0.120 |
| | | | Threonine | 20 | natural | NA | 0.125 | 0.125 | 0.110 |

TABLE 1-continued

Tribological properties (Observation of stick slip and friction coefficient (μ) according to the exerted pressure) for the tested metal sheet samples.

| Metal sheet | Oil | | Applied aqueous solution: Amino acid (natural) | Concentration of amino acid (g/L) | pH of the aqueous solution | Pressure (MPa) at which stick slip is observed | Friction coefficient (μ) at 40 MPa | at 60 MPa | at 80 MPa |
|---|---|---|---|---|---|---|---|---|---|
| EG | Quaker | | None(control) | NA | NA | 18 | 0.19 | 0.16 | 0.14 |
| DC06 | | | Proline | 70 | natural | NA | 0.15 | 0.12 | 0.11 |
| | | | Proline*** | 70 | natural | NA | 0.15 | 0.12 | 0.11 |
| Fortiform | | | None (control) | NA | NA | NA | 0.18 | 0.15 | 0.13 |
| | | | Proline | 70 | natural | NA | 0.13 | 0.12 | 0.11 |
| Zn JVD | Fuchs ® 4107S | A | None(control) | NA | NA | NA | 0.25 | 0.22 | 0.18 |
| | | | Proline | 10 | natural | NA | 0.24 | 0.20 | 0.17 |
| | | | Proline | 20 | natural | NA | 0.20 | 0.17 | 0.14 |
| | | B | None(control) | NA | NA | NA | 0.27 | 0.23 | 0.20 |
| | | | Proline | 10 | natural | NA | 0.24 | 0.20 | 0.17 |
| | | | Proline | 20 | natural | NA | 0.20 | 0.17 | 0.14 |
| | | | Proline | 70 | natural | NA | 0.14 | 0.12 | 0.10 |
| | Quaker | A | None(control) | NA | NA | NA | 0.26 | 0.23 | 0.20 |
| | | | Proline | 10 | natural | NA | 0.25 | 0.20 | 0.18 |
| | | | Proline | 20 | natural | NA | 0.20 | 0.17 | 0.15 |
| | | B | None(control) | NA | NA | NA | 0.26 | 0.23 | 0.20 |
| | | | Proline | 10 | natural | NA | 0.25 | 0.20 | 0.18 |
| | | | Proline | 20 | natural | NA | 0.20 | 0.17 | 0.15 |
| | | | Proline | 70 | natural | NA | 0.14 | 0.12 | 0.10 |

EG: electro-zinc-plated substrate
*pH adjusted by adding $H_3PO_4$
**test after having undergone a washing/re-oiling treatment
***test after having undergone a degassing heat treatment (24 hour heat treatment at 210° C. in an oven).

Example 2: Tests of Resistance to Corrosion and Tensile Tests for the Amino Acids Proline and Threonine

2.1. Tensile Tests

Tensile tests were conducted and are described as non-limiting examples.

Samples of steel sheets 1 covered with a metal coating 7 comprising about 99% of zinc (GI steel sheet), or else samples of steel sheets 1 which are electro-zinc-plated comprising 100% of zinc (EG steel sheet) were used.

Each specimen 27 was prepared in the following way. Tabs 29 were cut out in the metal sheet 1 to be evaluated. These tabs 29 had dimensions of 25 mm×12.5 mm×0.2 mm.

The tabs 29 were immersed for an immersion period of 20 s at a temperature of 50° C. in an aqueous solution of proline or threonine, the pH of which had to be adjusted by adding $H_3PO_4$, except for the reference metal sheets (Ref) not having been subject to any treatment with an amino acid.

Fuchs® 3802-39S oil was applied on the tabs 29 in an amount of 3 g/m$^2$.

Two tabs 29 were adhesively bonded with a gasket 31 of BM1496V, BM1440G or BM1044 adhesive, which are so called "crash">> adhesives based on epoxy and marketed by Dow® Automotive. These adhesives were selected since these are adhesives conventionally leading to adhesive fractures before ageing and/or after ageing of the adhesive.

The thereby formed specimen 27 was then brought to 180° C. and maintained at this temperature for 30 minutes, which gives the possibility of curing the adhesive.

Ageing tests were then carried out with the specimens 27, the tabs 29 of which were adhesively bonded with BM1044 adhesive. The natural ageing of the adhesive is simulated by ageing with a humid cataplasm at 70° C. for 7 or 14 days.

The tensile test was then achieved at a room temperature of 23° C. by imposing a traction speed of 10 mm/min to a tab 29, parallel with the latter, while the other tab 29 of the specimen 27 was fixed. The test was continued until fracture of the specimen 27.

At the end of the test, the maximum tensile stress was noted and the nature of the fracture was evaluated visually (cohesive fracture, when the fracture took place in the thickness of the adhesive—adhesive fracture, when the fracture took place at one of the interfaces between the metal sheet and the adhesive—surface cohesive fracture, when the fracture took place in the adhesive in the vicinity of an interface between the tabs and the metal sheet) (being aware that in the automobile industry, adhesive fractures are sought to be avoided which express poor compatibility of the adhesive with the metal sheet).

In table 2 are grouped the results on a GI metal sheet.

In table 3 are grouped the results on an electro-zinc-plated metal sheet (EG).

SCF means surface cohesive fracture.

As illustrated by the tables 2 and 3 below, the metal sheets 1 which have undergone a treatment with an aqueous solution comprising proline or threonine promote the occurrence of surface cohesive fractures, unlike the reference sheets for which more adhesive fractures were ascertained.

In particular, on the GI sheets (table 2):

With the BM1496V adhesive, the fracture structures observed on the tests with proline or threonine exclusively consist of surface cohesive fracture, unlike the reference not having been subject to any treatment (Ref 1) wherein 30% of adhesive fracture is ascertained.

With the BM1440G adhesive, the structural faces observed on the tests with proline or threonine also exclusively consist of surface cohesive fracture, unlike the reference not having been subject to any treatment (Ref 2) wherein 20% of adhesive fracture is ascertained, With the adhesive BM1044, it is observed that the adhesion of the adhesive on the metal sheets with proline and threonine (tests 7A to 7C) age better than on the reference, after 7 and 14 days of a humid cataplasm.

In particular, on the electro-zinc-plated metal sheets (table 3), with the adhesive BM1496V, the fracture structures observed on the tests 8A to 9B with proline or threonine are in majority formed with a surface cohesive fracture, unlike the reference not having been subject to any treatment (Ref 6) where 40% of adhesive fracture was ascertained.

TABLE 2

Maximum tensile stresses and natures of the fracture for the specimens based on the tested GI metal sheets.

| Test no. | Adhesive | Amino acid | Concentration g/L | pH | Ageing (days) | Max stress MPa | Fracture structure (SCF) |
|---|---|---|---|---|---|---|---|
| 2A | BM1496V | L-Proline | 20 | 4 | NA | 17.8 | 100% |
| 2B | | | 50 | | | 16.8 | 100% |
| 2C | | | 100 | | | 15.1 | 100% |
| 2D | | | 150 | | | 14.4 | 100% |
| 4A | | L-Threonine | 20 | 4 | NA | 16.8 | 100% |
| 4B | | | 50 | | | 15.9 | 100% |
| 4C | | | 80 | | | 15 | 100% |
| 4D | | | 100 | | | 14.8 | 100% |
| Ref 1 | | NA | NA | NA | NA | 17.9 | 70% |
| 6 | BM1440G | L-Proline | 50 | natural | NA | 14.5 | 100% |
| Ref 2 | | NA | NA | NA | NA | 14.9 | 80% |
| 7A | BM1044 | L-Proline | 50 | natural | NA | 10.6 | 100% |
| 7B | | | | | 7 | 11.5 | 100% |
| 7C | | | | | 14 | 11.3 | 90% |
| Ref 3 | | NA | NA | NA | NA | 11.8 | 100% |
| Ref 4 | | | | | 7 | 12 | 80% |
| Ref 5 | | | | | 14 | 11.5 | 60% |

TABLE 3

Maximum tensile stresses and natures of the fracture for the specimens based on tested electro-zinc-plated metal sheets.

| Test no. | Adhesive | Amino acid | Concentration (g/L) | pH | Ageing (days) | Max stress (MPa) | Fracture structure (SCF) |
|---|---|---|---|---|---|---|---|
| 9A | BM1496V | L-Proline | 20 | natural | NA | 12.2 | 95% |
| 9B | | | 50 | | | 10 | 100% |
| Ref 6 | | NA | NA | NA | NA | 14.6 | 60% |

2.2. Tests of Resistance to Corrosion

In order to illustrate the invention, tests of resistance to corrosion were conducted according to the ISO 6270-2 2005 standards and/or VDA 230-213 2008 standards on steel metal sheets 1 covered with a metal coating 7 comprising about 99% of zinc (GI steel sheet), or else samples of electro-zinc-plated steel sheets 1 comprising 100% of zinc (EG steel sheet), on which were applied:

an aqueous solution of proline or threonine, the pH of which was optionally adjusted by adding $H_3PO_4$, and then Fuchs® 3802-39S oil in an amount of 3 g/m$^2$, and then having been drawn.

It appears that the metal sheets 1 obtained by a method comprising the application of a solution of proline or threonine have better resistance to corrosion.

What is claimed is:

1. A method for preparing a metal sheet comprising at least the steps of:

providing a steel substrate, at least one face of which is coated with a metal coating comprising at least 40% by weight of zinc, applying on the outer surface of the metal coating an aqueous solution consisting of a mixture of water, an amino acid selected from the group consisting of alanine, arginine, aspartic acid, cysteine, glutamine, lysine, methionine, proline, threonine, each amino acid being in a neutral or salt form, and mixtures of said amino acids, each amino acid in the mixture independently in a neutral or salt form, and optionally a base, a mixture of bases, an acid, or a mixture of acids, the aqueous solution being free of compound comprising a metal from the group IIIB or from the group IVB and comprising less than 0.005 g/L of iron ions, and the mass percentage as dry extract of the amino acid in a neutral or salt form or of the mixture of amino acids in neutral or salt forms in the aqueous solution being greater than or equal to 50%, then performing a thermally degassing that obtains a metal sheet including a layer consisting of the amino acid or the mixture of said amino acids and optionally the base, the mixture of bases, the acid, or the mixture of acids.

2. The method according to claim 1, comprising a preliminary step for preparing the steel substrate, at least one face of which is coated with a metal coating, selected from among hot galvanization, sonic vapor jet deposition and an electro-zinc-plating of the steel substrate.

3. The method according to claim 1, wherein the metal coating is selected from a zinc coating GI, a coating GA, an alloy of zinc and aluminum, an alloy of zinc and of magnesium and an alloy of zinc, magnesium and aluminum.

4. The method according to claim 3, wherein the metal coating is an alloy of zinc and of magnesium comprising between 0.1 and 10% by weight of Mg and optionally between 0.1 and 20% by weight of Al, the remainder of the metal coating being Zn, the inevitable impurities and optionally one or several additional elements selected from among Si, Sb, Pb, Ti, Ca, Mn, Sn, La, Ce, Cr, Ni or Bi.

5. The method according to claim 1, wherein the amino acid is selected from the group consisting of alanine, arginine, aspartic acid, cysteine, lysine, methionine, proline, threonine, and & mixtures thereof, each amino acid being in a neutral or salt form.

6. The method according to claim 1, wherein the steel substrate, at least one face of which is coated with a metal coating has been prepared by electro-zinc-plating and the amino acid is selected from the group consisting of aspartic acid, cysteine, methionine, proline and threonine, and mixtures thereof, each amino acid being in a neutral or salt form.

7. The method according to claim 1, wherein the steel substrate, at least one face of which is coated with a metal coating has been prepared by hot galvanization and the amino acid is selected from the group consisting of alanine, arginine, cysteine, lysine, methionine, proline, threonine, and & mixtures thereof, each amino acid being in a neutral or salt form.

8. The method according to claim 1, wherein the amino acid is proline in a neutral or salt form, threonine in a neutral or salt form, or a mixture of proline and threonine, the proline and the threonine being in a neutral or salt form.

9. The method according to claim 1, wherein the aqueous solution comprises from 1 to 200 g/L of said amino acid in a neutral or salt form or a mixture of said amino acids in neutral or salt forms, or from 10 to 1,750 mmol/L of said amino acid in a neutral or salt form or a mixture of said amino acids in neutral or salt forms.

10. The method according to claim 1, wherein the mass percentage as dry extract of the amino acid in a neutral or salt form or of a mixture of amino acids in neutral or salt forms in the aqueous solution is greater than or equal to 75%.

11. The method according to claim 1, wherein the aqueous solution has a pH comprised between a pH equal to [isoelectric point of the amino acid−3] and a pH equal to the [isoelectric point of the amino acid+1].

12. The method according to claim 1, wherein the aqueous solution is applied at a temperature comprised between 20 and 70° C. and/or for a period comprised between 0.5 s and 40 s on the outer surface of the metal coating.

13. The method according to claim 1, wherein the solution is applied by roll coating.

14. The method according to claim 1, wherein the aqueous solution consists of a mixture of water, said amino acid, and said base, said mixture of bases, said acid, or said mixture of acids.

15. A method for preparing a metal sheet comprising at least the steps of:

providing a steel substrate, at least one face of which is coated with a metal coating comprising at least 40% by weight of zinc, applying on the outer surface of the metal coating an aqueous solution consisting of a mixture of water, an amino acid selected from among the group consisting of alanine, arginine, aspartic acid, cysteine, glutamine, lysine, methionine, proline, threonine, each amino acid being in a neutral or salt form, and mixtures of said amino acids, each amino acid in the mixture independently in a neutral or salt form, and optionally a base, a mixture of bases, an acid, or a mixture of acids, the aqueous solution being free of compound comprising a metal from the group IIIB or from the group IVB and comprising less than 0.005 g/L of iron ions, and the mass percentage as dry extract of the amino acid in a neutral or salt form or of the mixture of amino acids in neutral or salt forms in the aqueous solution being greater than or equal to 50%, upon drying, obtaining the metal sheet including a layer consisting of the amino or the mixture of said amino acids and optionally the base, the mixture of bases, the acid, or the mixture of acids, and performing at least one of the following on the layer consisting of the amino acid or the mixture of said amino acids and optionally the base, the mixture of bases, the acid, or the mixture of acids:

degreasing the metal sheet including the layer;

shaping by drawing the metal sheet including the layer;

cutting the metal sheet including the layer;

applying a film of grease or oil onto the layer;

applying an adhesive based on epoxy onto the layer;

phosphating the metal sheet including the layer; or performing a cataphoresis on the metal sheet including the layer.

16. A method for preparing a metal sheet comprising at least the steps of:

providing a steel substrate, at least one face of which is coated with a metal coating comprising at least 40% by weight of zinc, applying on the outer surface of the metal coating an aqueous solution consisting of a mixture of water, an amino acid selected from the group consisting of alanine, arginine, aspartic acid, cysteine, glutamine, lysine, methionine, proline, threonine, each amino acid being in a neutral or salt form, and mixtures of said amino acids, each amino acid in the mixture independently in a neutral or salt form, and optionally an acid, or a mixture of acids, the aqueous solution being free of compound comprising a metal from the group IIIB or from the group IVB and comprising less than 0.005 g/L of iron ions, and the mass percentage as dry extract of the amino acid in a neutral or salt form or of the mixture of amino acids in neutral or salt forms in the aqueous solution being greater than or equal to 50%.

17. The method according to claim 16, further comprising, after the step of applying on the outer surface of the metal coating the aqueous solution, a drying step.

18. The method according to claim 16, further comprising, after the step of applying on the outer surface of the metal coating the aqueous solution and an optional drying step, a step of applying a grease or oil film on the outer surface of the coating coated with a layer consisting of the amino acid or the mixture of said amino acids and optionally the acid, or the mixture of acids.

19. The method according to claim 16, further comprising, after the step of applying on the outer surface of the metal coating the aqueous solution comprising an amino acid, an optional drying step and an optional step of applying a grease or oil film, a step of shaping the metal sheet by drawing.

* * * * *